US006050057A

United States Patent [19]

Tuyn et al.

[11] Patent Number: 6,050,057

[45] Date of Patent: Apr. 18, 2000

[54] PACKING APPARATUS

[75] Inventors: Roberto Tuyn, Zaandam; Petrus Franciscus Kivits, Nieuwerkerk, both of Netherlands

[73] Assignee: Buhrs-Zaandam B.V., Zaandam, Netherlands

[21] Appl. No.: 09/053,522

[22] Filed: Apr. 2, 1998

[30] Foreign Application Priority Data

Apr. 7, 1997 [NL] Netherlands ..... 1005749

[51] Int. Cl.[7] ..... B65B 5/04

[52] U.S. Cl. ..... 53/376.2; 53/168; 53/550; 53/375.4; 53/504

[58] Field of Search ..... 53/504, 168, 547, 53/550, 374.4, 374.3, 375.4, 376.2

[56] References Cited

U.S. PATENT DOCUMENTS

| | | | |
|---|---|---|---|
| 3,750,361 | 8/1973 | Stevens | 53/32 |
| 4,056,922 | 11/1977 | Schilte | 53/373 |
| 4,430,844 | 2/1984 | James | 53/450 |
| 4,437,851 | 3/1984 | Salenbo | 493/124 |
| 4,715,166 | 12/1987 | Kameda | 53/550 |
| 4,842,123 | 6/1989 | Visser | 198/341 |
| 4,909,018 | 3/1990 | Yamamoto | 53/450 |
| 5,234,531 | 8/1993 | Ballestrazzi et al. | 156/359 |
| 5,255,495 | 10/1993 | Kovacs | 53/504 |
| 5,285,621 | 2/1994 | Ballestrazzi et al. | 53/556 |
| 5,406,773 | 4/1995 | Limousin | 53/550 |
| 5,423,162 | 6/1995 | Chiu | 53/550 |
| 5,477,656 | 12/1995 | Loewenthal | 53/374.4 |
| 5,647,192 | 7/1997 | Kivits et al. | 53/450 |
| 5,653,094 | 8/1997 | Kivits et al. | 53/461 |

FOREIGN PATENT DOCUMENTS

| | | |
|---|---|---|
| 0 282 112 | 9/1988 | European Pat. Off. . |
| 0 537 844 | 4/1993 | European Pat. Off. . |

*Primary Examiner*—Joseph J. Hail, III
*Assistant Examiner*—William Hong
*Attorney, Agent, or Firm*—Griffin, Butler, Whisenhunt & Szipl, LLP

[57] ABSTRACT

Packing apparatus for packing mail items, magazines, books, CDs and like products composed of one or more layers, comprising a product-assembling path, a folding station, and a separating station, the folding station comprising a first conveyor belt on which at least a part of the packing material web is located which extends below the products to be packed, a pulling element which is arranged above the first conveyor belt and engages parts of the packing material web located at the top side of the products to be packed, and connecting means by means of which the longitudinal edges of the packing material web are interconnected, a pressure plate which is arranged above the first conveyor belt, the top side of which pressure plate is engaged by the pulling element, in operation, with the interposition of at least the longitudinal edges of the packing material web, the distance between the first conveyor belt and the bottom side of the pressure plate being such that products of different thicknesses can pass therebetween.

6 Claims, 5 Drawing Sheets

PACKING APPARATUS

The invention relates to a packing apparatus for packing mail items, magazines, books, CDs and like products composed of one or more layers.

BACKGROUND OF THE INVENTION

In known such apparatus, there are an assembling path, in which products to be packed are assembled, a folding station comprising folding means by means of which the longitudinal edges of a continuous packing material web are folded around the products to be packed to form a continuous packing tube with products included therein, and a separating station by means of which the packing tube is divided in transverse direction between the products into loose, packed end products, the folding station comprising a first conveyor belt on which at least a part of the packing material web is located which extends below the products to be packed, a pulling element which is arranged above the first conveyor belt and engages parts of the packing material web located at the top side of the products to be packed, and connecting means by means of which the longitudinal edges of the packing material web are interconnected.

Such apparatus is known from European patent application EP-A-0 519 529.

In the known apparatus, the pulling element, with the interposition of at least the longitudinal edges of the packing material web, presses on the top side of the product to be packed. The product included into the tube of packing material web is thus clamped between the pulling element and the first conveyor belt. Because the pulling element is likewise designed as a conveyor belt whose conveying speed corresponds to the conveying speed of the first conveyor belt, the packing material web is pulled at both at the bottom side and at the top side of the product, whereby, apart from the product transport in the folding station, the energy required for the folding process is also provided. It is true that in the known apparatus, the distance between the pulling element and the conveyor belt is settable, but this distance is changed only occasionally for a series of products to be packed.

Hence, the major drawback of the known apparatus is that the random processing of products having mutually different thicknesses can be effected to a very limited extent only, if at all. However, from the nature of the packing apparatus, it follows that the products to be packed do not all have the same thickness. Indeed, in the product-assembling path, some products have more enclosures added thereto than other products. An enclosure can for instance be formed by a CD box added to a magazine and only intended for specific subscribers.

The object of the invention is to provide a packing apparatus whereby products of different thicknesses can be processed in random order without this requiring a change of the distance of the pulling element relative to the first conveyor belt.

SUMMARY OF THE INVENTION

To this end, according to the invention, the packing apparatus of the type described in the opening paragraph is characterized in that the folding station comprises a pressure plate arranged above the first conveyor belt, the top side of which pressure plate is engaged by the pulling element, in operation, with the interposition of at least the longitudinal edges of the packing material web, the distance between the first conveyor belt and the bottom side of the pressure plate being such that products of different thicknesses can pass therebetween.

Due to the presence of the pressure plate, the pulling element no longer experiences a counterpressure of the product to be packed, but only of the pressure plate. In this manner, in spite of the lack of the phenomenon of clamping the product to be packed between the pulling element and the first conveyor belt, the packing material web can nevertheless be pulled so that the product transport in the folding station is effected and, also, the energy required for the folding process is provided. As the pressure plate is arranged at such a height above the first conveyor belt that products of different thicknesses can pass between the pressure plate and the first conveyor belt, products of mutually different thicknesses can be processed randomly. Apart from this advantage, the pressure plate provides the additional advantage that the product can no longer become damaged as a consequence of the pressure exerted thereon by the pulling element.

To provide that the product transport is not only effected by pulling the part of the packing material web located at the top side of the product to be packed, according to a further elaboration of the invention, it is particularly favorable if the first conveyor belt is provided with passage openings. A vacuum chamber is arranged under the first conveyor belt, which vacuum chamber comprises at least one suction opening which abuts against the bottom surface of a top part of the first conveyor belt. The vacuum chamber creates a vacuum, so that via the passage openings, the packing material web is fixed onto the first conveyor belt through suction. In this manner, the part of the packing material web located below the product to be packed is pulled as well. Thus, the transport of the tube of packing material web containing the product to be packed takes place without any pressure being exerted on the product to be packed. Hence, the chance of damage to the product to be packed is minimized.

According to a further elaboration of the invention, for processing a plastic film web as packing material web, the connecting means by means of which the longitudinal edges of the packing material web are interconnected, can be designed as a sealing element disposed upstream of the pulling element, which sealing element, in operation, presses on the top side of the pressure plate, with the interposition of at least the longitudinal edges of the plastic film web. Such construction offers the advantage over the known packing apparatus that the sealing element does not exert pressure on the product to be packed but only on the pressure plate. Hence, the product to be packed cannot be damaged by the sealing element. Moreover, the chance of the plastic film sticking, during sealing, to the product to be packed is minimized.

If necessary, the distance between the pressure plate and the conveyor belt can be settable in that the pressure plate is arranged for displacement in vertical direction, with the pulling element and the sealing element, if present, also being arranged for adjustment in vertical direction. Changing the height setting is only necessary when a series of products that are all relatively thin is processed first, and a series of products that are all relatively thick should be processed next, or the other way round. It is a matter of course that with the apparatus according to the invention, a considerable variation in the thickness to be processed may occur within a series of relatively thin or within a series of relatively thick products. A variation in thickness within a series may easily be about 80 mm.

BRIEF DESCRIPTION OF THE DRAWINGS

Further elaborations of the invention are described herein and will be specified on the basis of an exemplary embodiment, with reference to the accompanying drawings. In these drawings.

DESCRIPTION OF PREFERRED EMBODIMENTS

Figure 1:
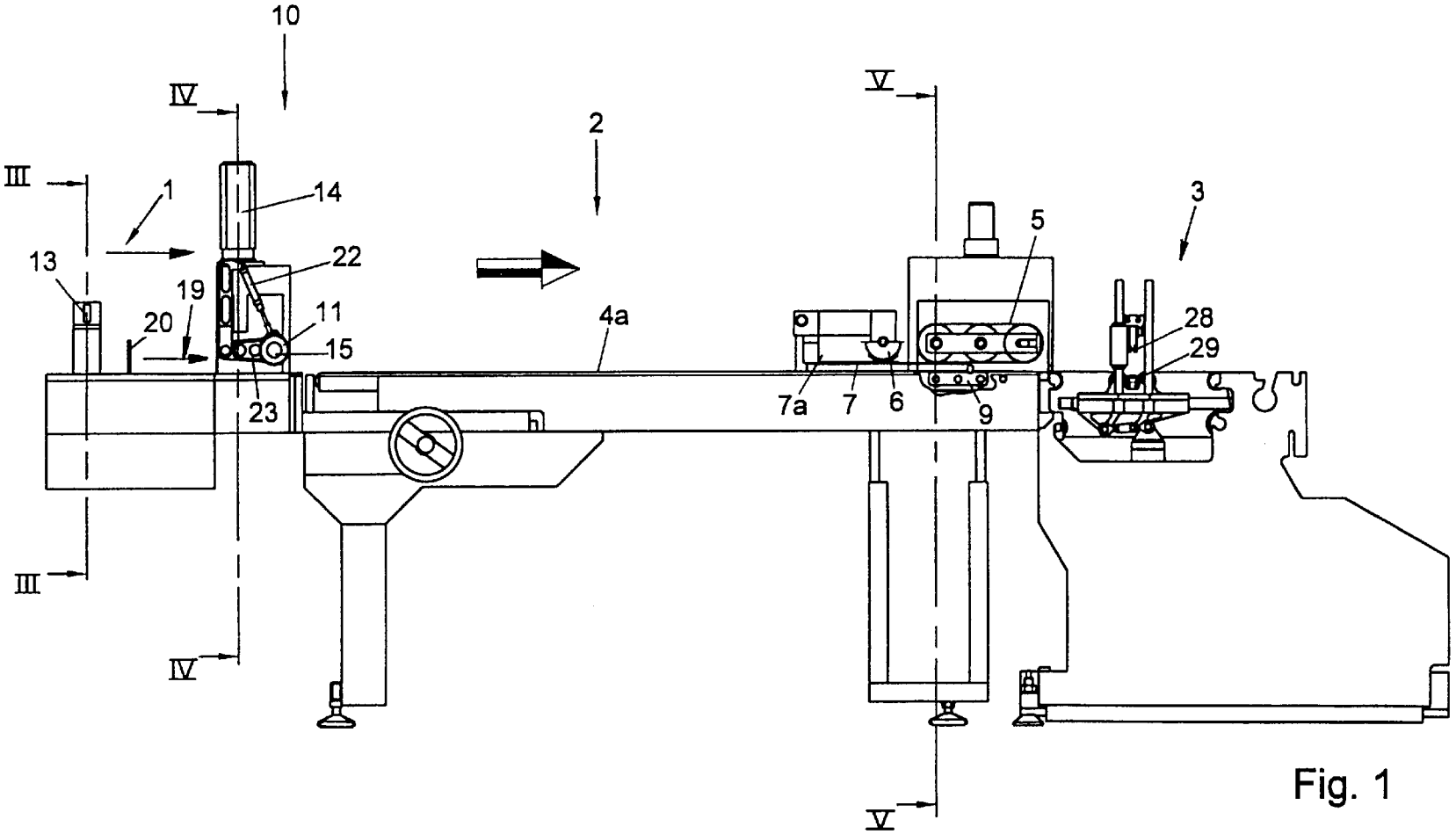
FIG. 1 is a side elevational view of an exemplary embodiment of the apparatus.

FIG. 1 schematically shows, in side elevational view, a portion of an exemplary embodiment of a packing apparatus for packing mail items, magazines, books, CDs and like products composed of one of more layers. Such packing apparatus comprises a product-assembling path 1, whose final portion is shown in FIG. 1 and in which products to be packed are assembled in that feeder stations feed enclosures and the like to a conveying path 19. On this conveying path 19, a thus assembled product is advanced by means of projections 20 connected to an endless chain 21 that is driven. Arranged at the end of the product-assembling path 1 is a product-positioning station 10 by means of which the assembled products are positioned in a controlled manner on a continuous packing material web of film or paper. This packing material web is brought into the product-conveying path downstream of the product-assembling path 1, at the inlet of the folding station 2. In applicant's packing apparatus, the packing material web, when manufactured from paper, is passed from the lower side of the product-conveying path over a so-called folding block into the product-conveying path. Such folding block is described in EP-A-0 686 555. After the products have been positioned on the packing material web by the product-positioning station 10, the longitudinal edges of the continuous packing material web are folded around the products to be packed to form a continuous packing tube with products included therein. To this end, the folding station 2 comprises folding means, which in applicant's packing apparatuses comprise, inter alia, the above-mentioned folding block and a so-called pulling element 5 in the form of a pulling belt 5. To guarantee the further transport of the packing material web with the products located thereon, the folding station 2 comprises a first conveyor belt 4 on which at least a part of the packing material web is located which extends under the products to be packed. The pulling element 5 mentioned is disposed above the first conveyor belt 4 and engages parts of the packing material web located at the top side of the products to be packed. The folding station further comprises connecting means 6 by means of which the longitudinal edges of the packing material web are interconnected.

Disposed downstream of the folding station 2 is a separating station 3 by means of which the packing tube formed in the folding station 2 is divided, in transverse direction between the products, into loose, packed products. Such separating station for instance comprises a cutting knife for cutting through, in transverse direction, a packing material web composed of paper, or a sealing beam 28 with counterpressure beam 29, as shown in the present exemplary embodiment, for sealing and at the same time separating the loose, packed products.

Figure 2:
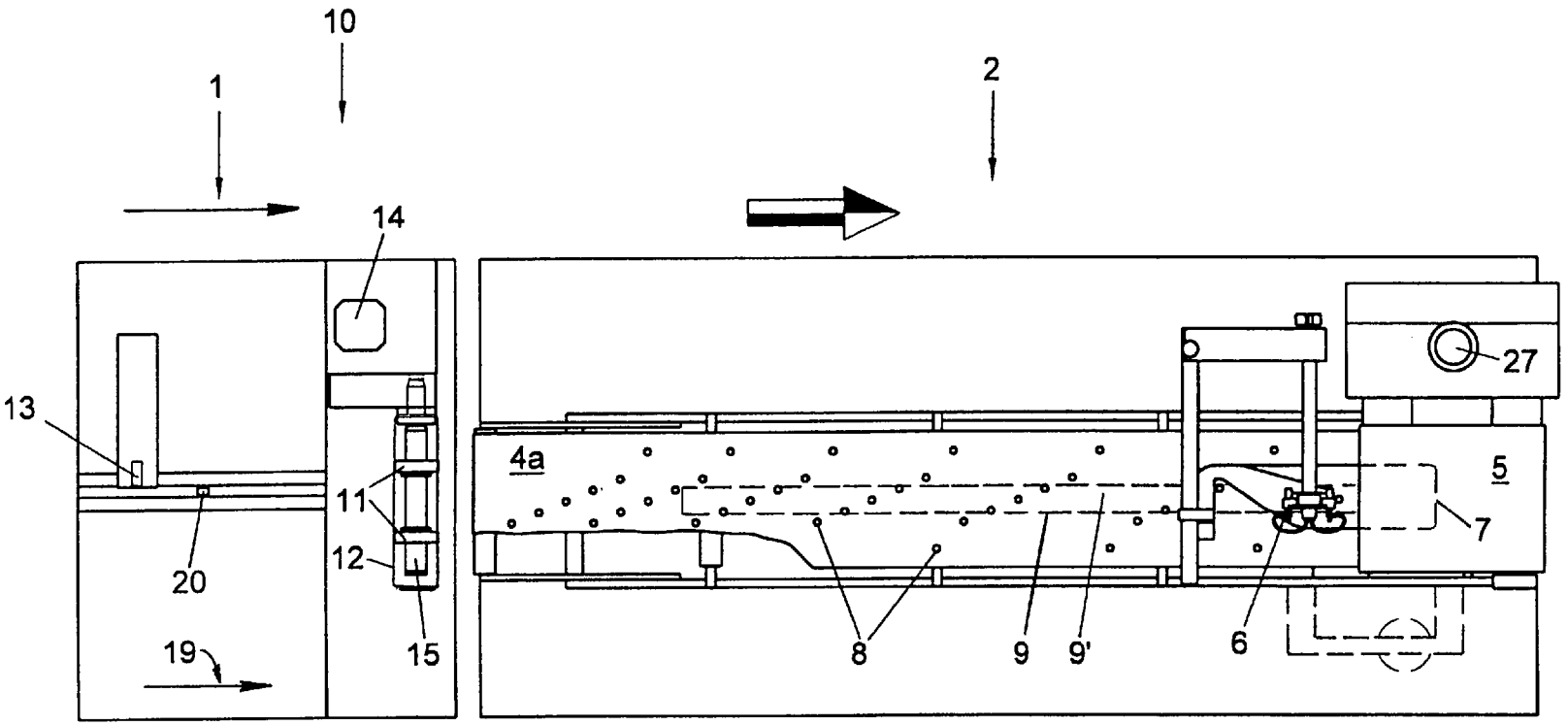
FIG. 2 is a top plan view of the exemplary embodiment shown in FIG. 1.
Figure 3:
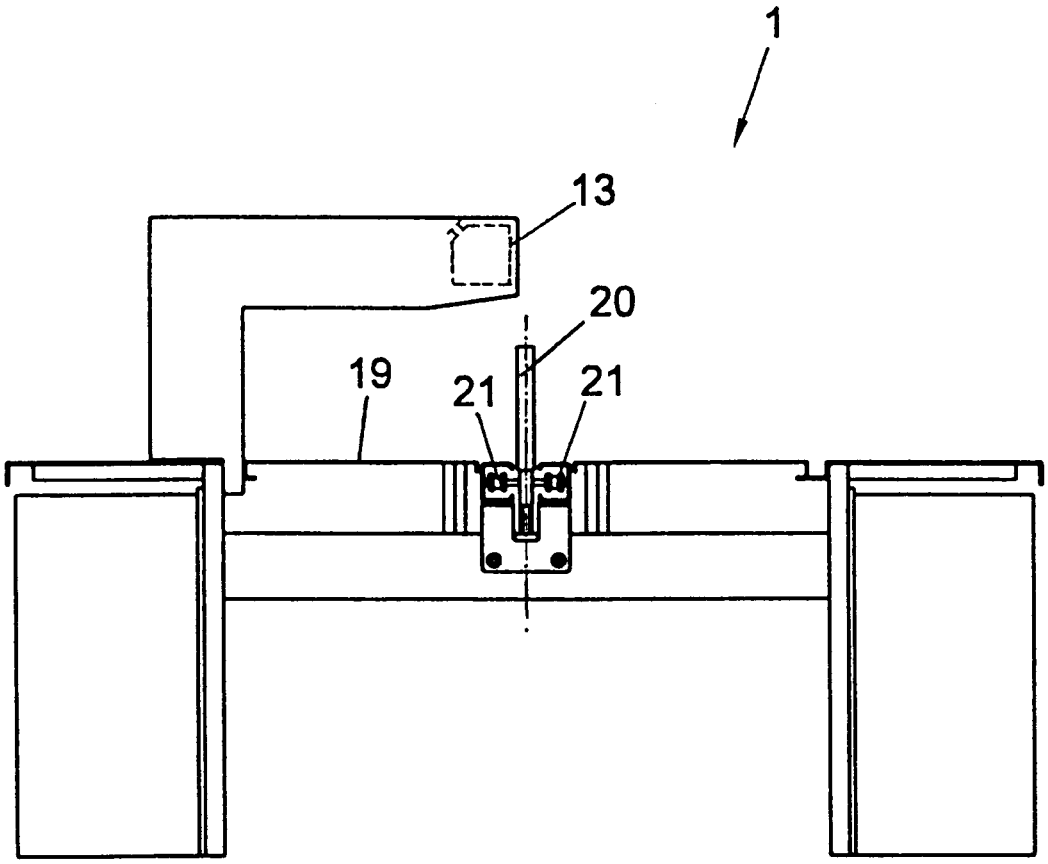
FIG. 3 is a sectional view taken on the line III—III in FIG. 1.

The product-positioning station 10 comprises an upper and a lower speed-influencing element 11 and 12 respectively, intended for engaging a bottom side and a top side respectively of the product to be packed. The speed of the upper speed-influencing element 11 always corresponds to the speed of the lower speed-influencing element 12. Moreover, the speeds of the two speed-influencing elements 11, 12 can be controlled continuously. Positioning is effected in that, at the start of the engagement of a product, the speed-influencing elements 11, 12 have a peripheral speed which corresponds to the conveying speed of a product as it enters. Next, the speed of the speed-influencing elements 11, 12 is varied during the engagement of the product such that the product is placed at a desired position on the packing material web. As is clearly visible in FIGS. 1 and 2, upstream of the product-positioning station 10, a sensor 13 is provided by means of which the height of a product is determined. The positioning station 10 comprises an actuator 14 by means of which the mutual distance between the upper and the lower speed-influencing element 11 and 12 respectively is continuously settable. The packing apparatus further comprises a control to which the sensor 13 and the actuator 14 are connected. The control is arranged so that the distance between the upper and the lower speed-influencing element 11, 12 always corresponds to the height of the product to be packed when this product to be packed arrives at the product-positioning station 10.

In the present exemplary embodiment, the sensor 13 is a laser displacement sensor, arranged above the product-assembling path 1 and measuring the distance to the top side of the product. The control is arranged for deriving from this distance the thickness of the product.

Preferably, the control is of such design that the sensor 13 measures the maximum thickness of a product to be processed. Next, the control provides that the distance between the speed-influencing elements 11, 12 corresponds to this maximum thickness when the product to be packed arrives at the product-positioning station and that this distance is maintained during a period to be set. This prevents the distance between the speed-influencing elements 11, 12 from varying each time during the engagement of a product, which would result in a highly irregular behavior and would moreover cause a very high load on the actuator 14.

Figure 4:
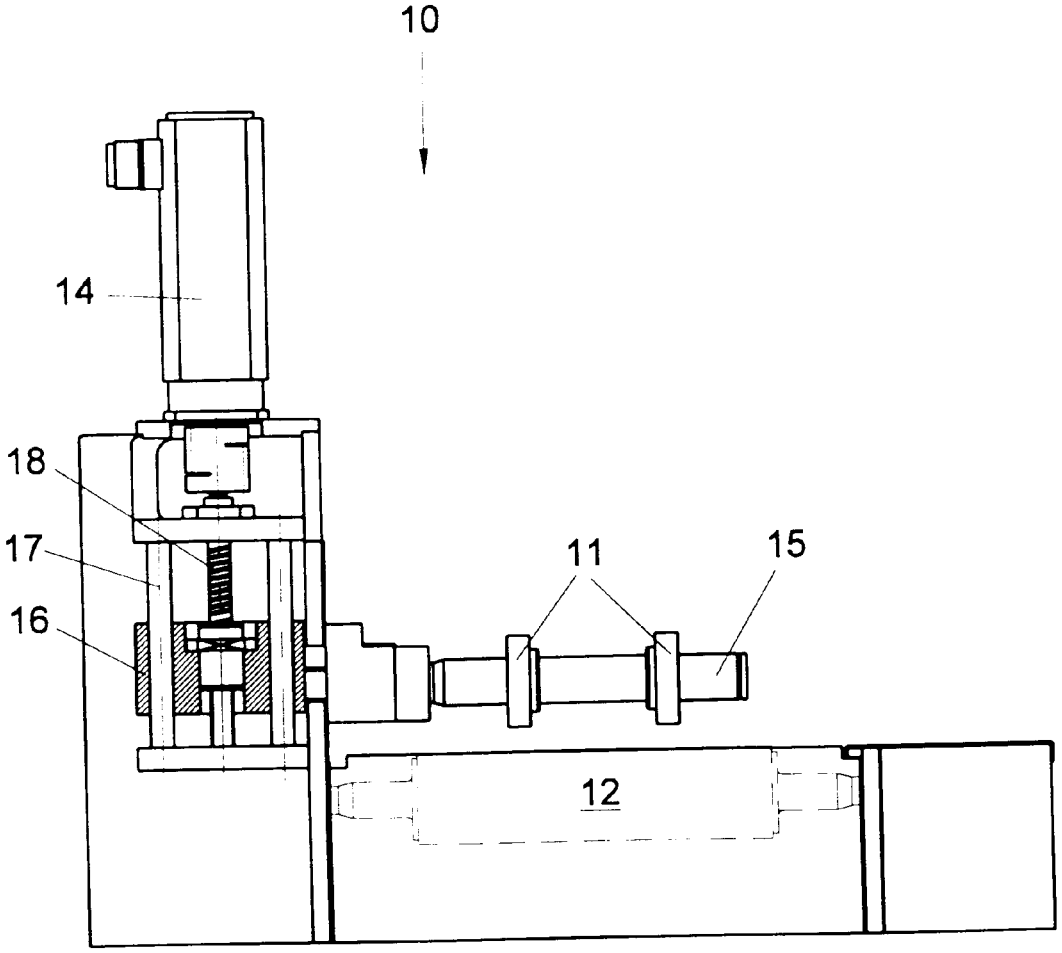
FIG. 4 is a sectional view taken on the line IV—IV in FIG. 1.

In the present exemplary embodiment, the actuator 14 is designed as a servomotor 14. As is clearly demonstrated in FIGS. 2 and 4, the speed-influencing elements 11, 12 are constructed as a number of top rollers 11 and a bottom roller 12. The rotary axle 15 of the top rollers 11 is bearing-mounted in a slide 16 which is bearing-mounted for sliding up and down in a guide 17. The servomotor 14 drives a spindle 18 which engages the slide 16 such that the vertical position of the top roller 11 is settable by means of the servomotor 14. In order to take up small differences in thickness without adjusting the top roller 11, it is particularly favorable if each top roller 11 is bearing-mounted so as to be spring-loaded in vertical direction. In the present exemplary embodiment, the spring is formed by a pneumatic telescope 22. The rotary axle 15 of the top rollers 11 is bearing-mounted in the slide 16 via a pivotable arm 23. The rotational drive of the top roller 11 and the bottom roller 12 takes place by means of a single drive motor having a continuously variable speed. For this purpose, the top roller 11 and the bottom roller 12 are drivably interconnected via a Schmidt-coupling, known per se, as described in EP-A-0 685 417.

In the present exemplary embodiment, the folding station 2 comprises a pressure plate 7 arranged above the first conveyor belt 4. In operation, the top side of this pressure plate 7 is engaged by the pulling element 5, with the interposition of at least the longitudinal edges of the packing material web. The distance between the first conveyor belt 4 and the bottom side of the pressure plate 7 is such that products of different thicknesses can pass therebetween. Upstream of the pressure plate 7, the longitudinal edges of the packing material web do not yet lie on top of each other, while directly downstream of the vertical portion 7*a* of the pressure plate 7, these longitudinal edges lie on top of each other.

In order to exert a pulling force also on the parts of the packing material web located below the products to be packed, the first conveyor belt 4 in the present exemplary embodiment is provided with passage openings 8. Arranged below the first conveyor belt 4 is a vacuum chamber 9, which vacuum chamber 9 is provided with at least one suction opening 9' abutting against the bottom surface of a top part 4*a* of the first conveyor belt 4. By means of this vacuum chamber 9, a vacuum is created, so that, via the passage openings 8, the packing material web is fixed onto the first conveyor belt 4 through suction.

For processing a plastic film web as packing material web, the connecting means 6 by means of which the longitudinal edges of the packing material web are interconnected, is in the form of a sealing element arranged upstream of the pulling element 5. In operation, the sealing element presses on the top side of the pressure plate 7, with the interposition of at least the longitudinal edges of the plastic film web.

For processing a paper as packing material web, the connecting means 6 by means of which the longitudinal edges of the packing material web are interconnected, is in the form of at least one glue gun which is arranged upstream of the pulling element 5 and which is designed for applying adhesive to at least one of the longitudinal edges of the paper web. In general, this glue gun, not shown in the present exemplary embodiment, will be located upstream of the vertical part 7*a* of the pressure plate, because at that location, the longitudinal edges of the packing material web do not yet lie on top of each other. The pressure required for effecting the adhesive connection is provided by the pulling element 5 pressing on the pressure plate 7.

Preferably, the distance between the pressure plate 7 and the conveyor belt 4 is settable in that the pressure plate 7 is arranged so as to be displaceable in vertical direction. In that case, the pulling element 5 and the sealing element, if present, should of course likewise be arranged so as to be displaceable in vertical direction.

In the present exemplary embodiment, the pulling element 5 is designed as an endless second conveyor belt 5. The conveying speed of the second conveyor belt 5 corresponds to the conveying speed of the first conveyor belt 4. In this manner, a uniform transport of both the bottom side and the top side of the packing tube is effected without the products having to be clamped between the two conveyor belts.

Figure 5:
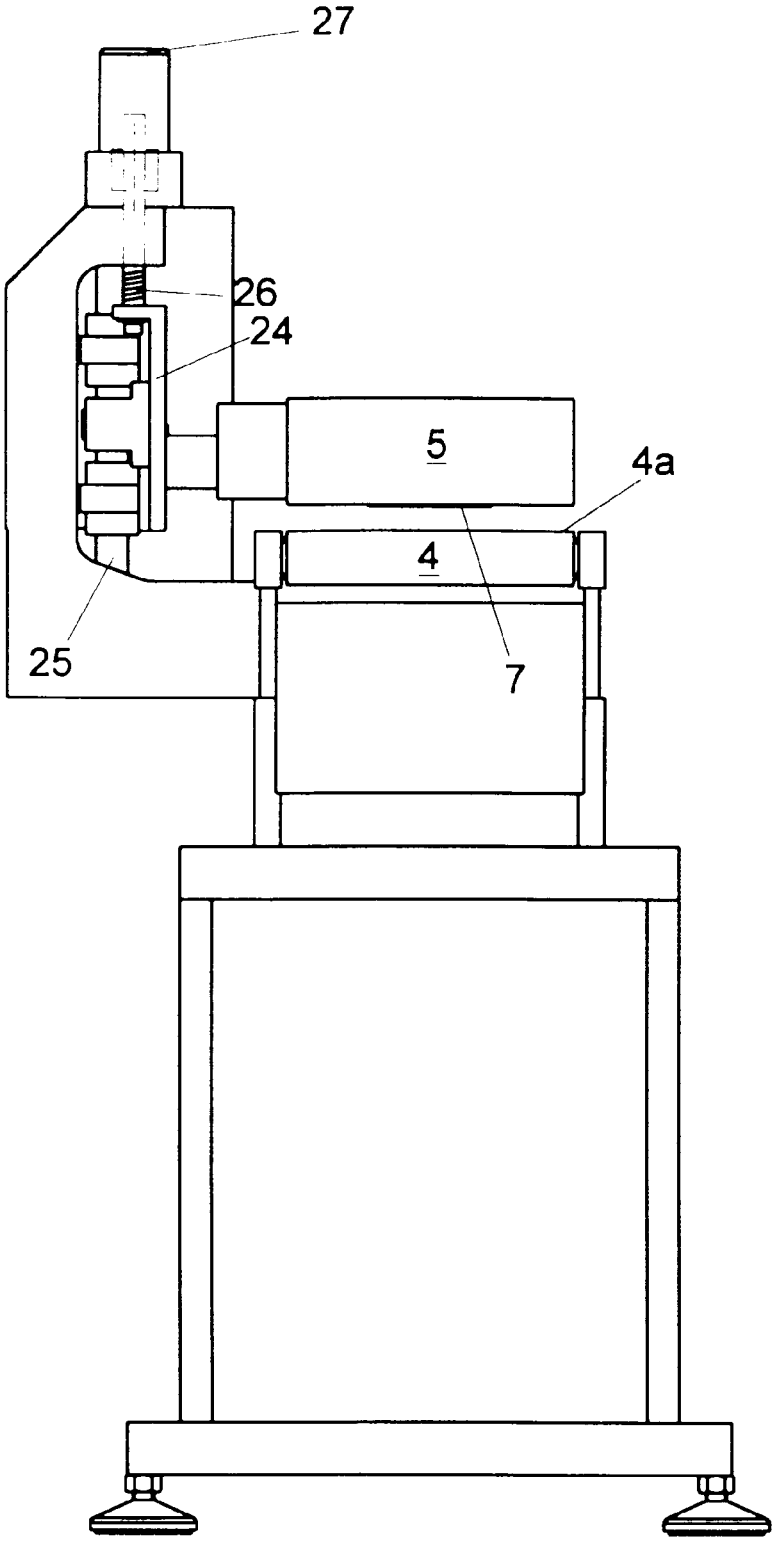
FIG. 5 is a sectional view taken on the line V—V in FIG. 1.

As is clearly demonstrated in FIG. 5, for the purpose of its vertical adjustment, the pulling element 5 is suspended in a vertically adjustable frameplate 24 which is bearing-mounted on a vertical guide 25. The frameplate 24 is engaged by a screw spindle 26 which is connected to an adjusting knob 27 so as to be restrained from rotation. Due to the presence of the pressure plate 7, the variation in thickness within a series of products to be packed may increase to about 80 mm. When the products to be packed have a thickness of about 160 mm, the height of the pulling element 5 above the top part 4*a* of the conveyor 4 should be set at about 200 mm by means of the adjusting knob 27, so that products having a thickness of 200 mm as well as products having a thickness of 120 mm can be processed. Hence, the adjusting knob 27 serves for the setting per series of products to be processed. Within this series of products to be processed, a considerable variation in thickness may occur without this causing problems during the packing process.

It is readily understood that the invention is not limited to the exemplary embodiment described, but that various modifications are possible within the framework of the invention.

We claim:

1. In a packing apparatus for packing mail items, magazines, books, CDs and like products composed of one or more layers of the products, and having a product-assembling path (1) for assembling the layers of products, a folding station (2) for folding longitudinal edges of a continuous packing material web around the layers of products to form a continuous packing tube with products therein, and a separating station (3) for dividing the packing tube in a transverse direction between the layers of products, and wherein the folding station (2) comprising a first conveyor belt (4) on which at least a part of the packing material web is located which extends below the layers of products to be packaged, a pulling element (5) which is arranged above the first conveyor belt (4) and engages parts of the packing material web located at a top side of the products to be packed, and connecting means (6) for interconnecting the longitudinal edges of the packing material web, the improvement comprising a folding station (2) comprising a pressure plate (7) arranged above the first conveyor belt (4), a top side of said pressure plate (7) being engaged by the pulling element, in operation, with the interposition of at least the longitudinal edges of the packing material web between the pressure plate (7) and the pulling element (5), and wherein the distance between the first conveyor belt (4) and a bottom side of the pressure plate (7) is such that layers of products of different thicknesses can pass therebetween.

2. A packing apparatus according to claim 1, wherein the first conveyor belt (4) is provided with passage openings (8), a vacuum chamber (9) is arranged under the first conveyor belt (4) and has at least one suction opening (9') which abuts against a bottom surface of a top part (4*a*) of the first conveyor belt (4), such that a vacuum is created in the passage openings (8) and the packing material web is fixed onto the first conveyor belt (4) through suction.

3. A packing apparatus according to claim 1, wherein for processing a plastic film web as the packing material web, the connecting means (6) is a sealing element disposed upstream of the pulling element (5), said sealing element (6), in operation, pressing on the top side of the pressure plate (7), with the interposition of at least the longitudinal edges of the plastic film web.

4. A packing apparatus according to claim 1 wherein distance between the pressure plate (7) and the conveyor belt (4) is settable in that the pressure plate (7) is arranged for displacement in a vertical direction, with the pulling element (5) and the sealing element (6), also being arranged for adjustment in vertical direction.

5. A packing apparatus according claim 1 wherein the pulling element (5) is an endless second conveyor belt, the conveying speed of the second conveyor belt corresponding to the conveying speed of the first conveyor belt (4).

6. A packing apparatus according to claim 1, wherein for processing a paper web as the packing material web, the connecting means is at least one glue gun arranged upstream of the pulling element (5) for applying adhesive to at least one of the longitudinal edges of the paper web.

* * * * *